US009788128B2

(12) United States Patent
Kirkwood et al.

(10) Patent No.: US 9,788,128 B2
(45) Date of Patent: Oct. 10, 2017

(54) HEARING INSTRUMENT WITH OFF-LINE SPEECH MESSAGES

(71) Applicant: GN Hearing A/S, Ballerup (DK)

(72) Inventors: Brent C. Kirkwood, Copenhagen O (DK); Brian Dam Pedersen, Ringsted (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 13/921,178

(22) Filed: Jun. 18, 2013

(65) Prior Publication Data

US 2014/0369536 A1 Dec. 18, 2014

(30) Foreign Application Priority Data

Jun. 14, 2013 (DK) ..... 2013 70320
Jun. 14, 2013 (EP) ..... 13172097

(51) Int. Cl.
*H04R 25/00* (2006.01)

(52) U.S. Cl.
CPC ..... *H04R 25/55* (2013.01); *H04R 2225/55* (2013.01)

(58) Field of Classification Search
None
See application file for complete search history.

(56) References Cited

U.S. PATENT DOCUMENTS 7,412,288 B2 * 8/2008 Berg ..... 607/57
8,694,306 B1 * 4/2014 Short et al. ..... 704/200
9,113,287 B2 * 8/2015 Aldaz ..... H04W 4/008
9,124,983 B2 * 9/2015 Recker ..... H04R 25/40
9,173,180 B2 * 10/2015 Philips ..... H04W 56/001
2005/0027537 A1 * 2/2005 Krause et al. ..... 704/271
2005/0251224 A1 * 11/2005 Berg ..... H04R 25/505 607/57
2006/0045278 A1 * 3/2006 Aceti ..... 381/23.1
2007/0057798 A1 * 3/2007 Li ..... G08B 25/016 340/573.1
2009/0076804 A1 * 3/2009 Bradford et al. ..... 704/203
2009/0158423 A1 * 6/2009 Orlassino et al. ..... 726/19
2010/0097239 A1 * 4/2010 Campbell ..... B60R 11/0252 340/4.4
2010/0260363 A1 * 10/2010 Glatt ..... G10H 1/0066 381/312

(Continued)

FOREIGN PATENT DOCUMENTS

EP 1596362 A1 11/2005
WO 2010033955 A1 3/2010

OTHER PUBLICATIONS

Extended European Search Report dated Nov. 14, 2013, for related European Patent Application No. EP 13172097.1, 7 pages.

(Continued)

*Primary Examiner* — Maria El-Zoobi
(74) *Attorney, Agent, or Firm* — Vista IP Law Group, LLP

(57) ABSTRACT

A hearing instrument configured for use with a device, the hearing instrument includes: an interface for reception of a message and/or a speech message from the device, wherein the speech message is a converted form of the message and is generated using a text-to-speech processor; a memory for storage of the message and/or the speech message, and a message processor configured for, at a selected time, outputting audio samples of the speech message for transmission to a user of the hearing instrument.

35 Claims, 4 Drawing Sheets

(56) References Cited

U.S. PATENT DOCUMENTS

| | | | | |
|---|---|---|---|---|
| 2011/0022203 | A1* | 1/2011 | Woo | G06F 9/4413 700/94 |
| 2012/0213393 | A1* | 8/2012 | Foo et al. | 381/315 |
| 2012/0215532 | A1* | 8/2012 | Foo et al. | 704/235 |
| 2013/0079061 | A1* | 3/2013 | Jadhav | H04M 1/72547 455/563 |
| 2013/0142365 | A1* | 6/2013 | Lord | H04M 3/42391 381/312 |
| 2013/0144623 | A1* | 6/2013 | Lord et al. | 704/249 |
| 2013/0294610 | A1* | 11/2013 | Munk | H04R 25/453 381/60 |
| 2013/0343585 | A1* | 12/2013 | Bennett et al. | 381/315 |
| 2014/0079248 | A1* | 3/2014 | Short et al. | 381/119 |
| 2015/0286459 | A1* | 10/2015 | Habets | G10K 11/346 700/94 |

OTHER PUBLICATIONS

First Technical Examination and Search Report dated Jan. 27, 2014 for related Danish Patent Application No. PA 2013 70320, 8 pages.

* cited by examiner

HEARING INSTRUMENT WITH OFF-LINE SPEECH MESSAGES

RELATED APPLICATION DATA

This application claims priority to and the benefit of Danish Patent Application No. PA 2013 70320, filed on Jun. 14, 2013, and European Patent Application No. 13172097.1, filed on Jun. 14, 2013. The entire disclosures of both of the above applications are expressly incorporated by reference herein.

FIELD OF TECHNOLOGY

A new hearing instrument is provided with capability of presenting speech messages, such as calendar reminders, tweets, sms-messages, notifications, etc., e.g., from a user's time management and communication systems at selected points in time.

BACKGROUND

Personal time management may be performed with a computer, e.g. using an email system with electronic calendar, to-do-lists, and notes to manage daily activities and communications. Communication may also be performed via electronic social and professional networks.

In some cases, a user recording an event or a task to be performed also records a reminder to be displayed to the user in advance to remind the user of the upcoming event or the task to be performed. Likewise, notifications may be displayed on a computer indicating incoming communication, such as receipt of a new email or updates in the social or professional networks, etc.

Notifications and reminders typically include a sound to make the user aware of the reminder or notification. Having heard the sound, the user typically has to consult a display on a computer, tablet computer, smart phone, or mobile phone, in order to know what event or task, a particular reminder or notification relates to.

In the event that the user is wearing a hearing instrument, e.g. a hearing aid, the user may miss one or more notifications and/or reminders.

SUMMARY

A new method of communicating a message to a human wearing a hearing instrument is provided, comprising the steps of retrieving the message from a device with access to a Wide-Area-Network, converting the message into a corresponding speech message, storing one of the message and the corresponding speech message in a memory of the hearing instrument together with timing information, and playing the corresponding speech message back to the human at a date and time of day as defined by the timing information.

A new hearing instrument system is also provided, having a hearing instrument and a device, wherein the device has a central processor configured for controlling a first interface configured for connection with a Wide-Area-Network, a second interface configured for connection with the hearing instrument, reception of information relating to the user through the Wide-Area-Network, and transmission of a message based on the information to the hearing instrument, and wherein the hearing instrument system further comprises a text-to-speech processor configured for conversion of the message into audio samples of a corresponding speech message, and wherein the hearing instrument has an interface for reception of one of the message and the speech message from the device, a memory for storage of one of the message and the speech message, and a message processor configured for, at a selected time, transmitting audio samples of the speech message to a user of the hearing instrument system.

The device may comprise the text-to-speech processor configured for conversion of the message into the corresponding speech message, and the central processor may be configured for controlling the transmission of the corresponding speech message to the hearing instrument.

Alternatively, the hearing instrument may comprise the text-to-speech processor.

Through the Wide-Area-Network, e.g. the Internet, the device has access to electronic time management and communication tools used by the user for communication and for storage of time management and communication information relating to the user. The tools and the stored information typically reside on a remote server accessed through the Wide-Area-Network. A plurality of the devices with interfaces to the Wide-Area-Network may access the tools through the Wide-Area-Network and may store the information relating to the user.

The device may access the Wide-Area-Network through a mobile telephone network, such as GSM, IS-95, UMTS, CDMA-2000, etc.

Each of the devices may be synchronized with the remote server when connected with the remote server through the Wide-Area-Network, e.g. according to a user defined schedule, so that the information stored in the device is consistent with the information stored in the remote server, i.e. during synchronization, the information in the remote server is updated with possible changes entered into the device by the user subsequent to the previous synchronization, e.g. the user may have entered new information, such as a new meeting in the calendar, during a period of time, when the device was not connected to the remote server; and the information in the device is also updated with possible changes entered into the remote server subsequent to the previous synchronization, e.g. another person may have send an invitation to a new meeting to the user.

The tools may include electronic calendar system(s), email system(s), such as Microsoft Outlook Express, Lotus notes, Windows Mail, Mozilla Thunderbird, Postbox, Apple Mail, Opera Mail, KMail, Hotmail, Yahoo, Gmail, AOL, etc, social network(s), professional network(s), such as Facebook®, LinkedIn®, Google+, tumblr, Twitter, MySpace, etc, RSS/Atom feeder(s), such as Bloglines, Feedly, Google Reader, My Yahoo!, NewsBlur, Netvibes, etc, news feeder(s), etc, well-known for management of daily activities and communications.

The information may include tasks to be performed, calendar dates, such as birthdays, anniversaries, appointments, meetings, etc, contacts, websites of interest, etc.

The device may reside in, and may share resources with, any type of computer, tablet PC, PDA, mobile phone, smart phone, etc.

The device may comprise the text-to-speech processor configured to generate a corresponding speech message, such as a spoken reminder, from the information that is stored and updated using the tools. The corresponding speech message may be stored as digital audio samples in an audio file in a memory in the device for subsequent transmission to the hearing instrument, e.g. upon detection of connection with the hearing instrument, possibly together with timing information, such as a date and time of day, or corresponding to a specific date and time of day, e.g. the number of seconds, minutes, hours and/or days in advance of term expiry of the recorded event or task, the reminder should be presented to the user, e.g. 3 days before a recorded birthday, or defined by the number of seconds, minutes, hours and/or days that have to elapse from data entry until presentation of the speech message to the user, etc, constituting the selected time for play back of the corresponding speech message to the user. In this way, a text-to-speech processor is not required in the hearing instrument.

Alternatively, the hearing instrument may comprise the text-to-speech processor. The message may be converted to the corresponding speech message at the time of play back of the corresponding speech message to the user; or, the message may be converted to the corresponding speech message at the time of receipt of the message by the hearing instrument, and the audio samples may be stored in a memory in the hearing instrument for play back at the selected time.

The device may be synchronized with the remote server when connected with the remote server through the Wide-Area-Network, e.g. according to a user defined schedule.

Typically, when the user records or edits an event that requires attention or a task to be performed, the tools provide the option of specifying a reminder to be sent to the user in advance. Typically, the user may select that the reminder is forwarded as an SMS and/or an email and/or displayed in a pop-up window on a computer and/or forwarded as a corresponding speech message to the hearing instrument.

Further, the user may select how long time in advance, e.g. seconds, minutes, hours and/or days, the reminder is to be presented to the user, e.g. by specifying the number of seconds, minutes, hours and/or days before the term of the recorded event or task, the reminder has to be presented to the user, e.g. 3 days before a recorded birthday, or by specifying the actual date and time of day, the reminder has to be presented to the user, or by specifying the number of seconds, minutes, hours and/or days that have to elapse from data entry until presentation of the reminder to the user, etc.

Typically, the tools also provide notifications to the user of incoming communication, such as receipt of a new email, SMS, instant message, traffic announcement, etc, or receipt of updates in social or professional networks, such as Facebook, Twitter, LinkedIn, etc, RSS/Atom feeds, etc.

The message may include such notifications.

The message may also include the new incoming information, e.g. an email, an SMS, a post in social or professional network, a blog post, an RSS/Atom feed, a news feed, an instant message, etc.

Thus, examples of corresponding speech messages include reminders on, e.g. meetings, birthdays, social gatherings, journeys, to-do items, etc, and notifications on, e.g., tweets, emails, news, traffic updates, social network updates, web page updates, etc, and communication, e.g. an email, an SMS, a post in social or professional network, a blog post, an RSS/Atom feed, a news feed, an instant message, etc.

Some corresponding speech messages may be played back immediately upon receipt by the hearing instrument.

Corresponding speech messages to be played back immediately may be transmitted to the hearing instrument together with timing information equal to zero.

The corresponding speech message may be accompanied by a notification jingle, such as a personalized notification jingle.

The message, or the corresponding speech message, may be removed automatically from the memory of the hearing instrument after play back in order to make the part of the memory occupied by the message, or corresponding speech message, available to a new message, or corresponding speech message.

Alternatively, the message, or the corresponding speech message, may be kept in memory of the hearing instrument after play back in order to make it available for subsequent repeated play back.

Typically, the user may access the tools and the stored information from any type of computer or device that is connected to the Wide-Area-Network by logging-in to a specific account, e.g. with a username and a password.

When logged-in to the account in question, the user may authenticate other devices to access the tools and the stored information without further authentication.

In order for the device to be authenticated and allowed access to the tools and the stored information, the user may have to log onto the corresponding accounts from the device.

The hearing instrument has an interface for reception of the message, or the corresponding speech message, from the device, and a memory for storage of the message, or the corresponding speech message.

The message processor is configured for, at the selected time, control play back of the corresponding speech message by transmission of the corresponding speech message to an output transducer for conversion of the corresponding speech message into an acoustic output signal for transmission towards an eardrum of the user of the hearing instrument.

The hearing instrument may be a hearing aid, such as a BTE, RIE, ITE, ITC, or CIC, etc, hearing aid including a binaural hearing aid; or, the hearing instrument may be a headset, headphone, earphone, ear defender, or earmuff, etc, such as an Ear-Hook, In-Ear, On-Ear, Over-the-Ear, Behind-the-Neck, Helmet, or Headguard, etc.

For example, the new hearing instrument system is a new hearing aid system with a new hearing aid having a microphone for provision of an audio input signal in response to sound signals received at the first microphone, a hearing loss processor that is configured to process the audio input signal in accordance with a predetermined signal processing algorithm to generate a hearing loss compensated audio signal, a receiver for conversion of the hearing loss compensated audio signal to an acoustic output signal, an interface for reception of the message, e.g. as audio samples of a corresponding speech message, from the device, the memory for storage of the message, and wherein the message processor configured for, at the selected time, play back the message as the corresponding speech message by transmitting audio samples of the corresponding speech message to a D/A converter for conversion into an analogue audio signal output to the receiver for converting the analogue audio signal into an acoustic signal for transmission towards the eardrum of the user of the hearing aid system.

The hearing instrument, such as the hearing aid, may have a timer providing information on date and time of day, and the message processor may be configured for transmitting the message at a selected date and time of day.

The timer may be synchronized with the device, e.g. whenever data, such as the message, is transmitted to the hearing instrument.

The new hearing instrument system takes advantage of the fact that a user of the hearing instrument system, especially a hearing aid user, already wears the hearing instrument and therefore, the user is able to listen to corresponding speech messages without having to perform additional tasks, such as mounting a headphone or headset on his or her head, bringing a telephone to the ear, and/or looking at a screen and/or select information to be displayed and/or played back, and/or looking at a dashboard of a car and/or select information to be displayed and/or played back, etc.

The hearing instrument may have a wireless interface, for reception of data transmitted by the device, including messages or corresponding speech messages or distinct sounds, such as short single note tones, or distinct sequences of notes, such as notification jingles, such as a personalized notification jingles, and possibly the selected time, i.e. timing information specifying when the hearing instrument is controlled to play back the corresponding speech message.

The hearing instrument may have a wired interface for reception of data transmitted by the device, including messages or corresponding speech messages or distinct sounds, such as short single note tones, or distinct sequences of notes, such as notification jingles, such as a personalized notification jingles, and possibly the selected time, i.e. timing information specifying when the hearing instrument is controlled to play back the corresponding speech message. The wired interface may, e.g., be used during possible docking of the hearing instrument, e.g. docking for recharging of the hearing instrument.

When the hearing instrument is within receiving range of the device transmitter, and the communication link between the hearing instrument and the device is established, the communication link may be used to synchronize the hearing instrument with the device, e.g. a timer of the hearing instrument may be synchronized with a timer of the device, and any new message; or, new messages to be presented to the user within a certain time period, e.g. within the next 24 hours, within the next week, within the next month, etc., may be transferred to the hearing instrument together with possible timing information on respective dates and times for play back of the corresponding speech messages to the user. Synchronizing data for a limited time period lowers the memory requirements of the hearing instrument. Alternatively, the amount of available memory may be calculated and a corresponding number of new messages may be transferred to the hearing instrument together with possible timing information on respective dates and times for play back of the corresponding speech messages to the user. In this way, the available memory is used to store as many messages as possible.

The user may use a user interface of the device to input time management and/or communication information to the tools as is well-known in the art.

The device may comprise the user interface, or part of the user interface, of the hearing instrument.

The hearing instrument may have a user interface, e.g. one or more push buttons, and/or one or more dials as is well-known from conventional hearing instruments.

The hearing instrument system may have a user interface configured for reception of spoken user commands to control operation of the hearing instrument system.

The user may use the user interface of the hearing instrument to command the hearing instrument to sequentially play back the messages currently stored in the memory of the hearing instrument, e.g. in ascending or descending order of time of receipt, in ascending or descending order of time to be played back, etc, e.g. specified by the user using the user interface of the hearing instrument and/or previously specified by the user during access to the tools.

The user may delete messages stored in the memory, using the user interface of the hearing instrument and/or the device.

The user may select a new time for the message to be played back using the user interface of the hearing instrument and/or the device. The new time may substitute or be added to the previous time for the message to be played back, e.g. also specified by the user using the user interface of the hearing instrument and/or the device.

The user may delete the time for the message to be played back without deleting the message itself from the memory of the hearing instrument using the user interface of the hearing instrument and/or the device.

The user may select to mute all or selected received messages using the user interface of the hearing instrument and/or the device. Subsequently, the user may select to un-mute all or selected received messages using the user interface of the hearing instrument and/or the device.

The selected time may be a time for playing back the corresponding speech message as previously specified by the user during recording or editing of the event or task in question and transmitted to the hearing instrument together with the message for storage in the hearing instrument.

The corresponding speech message may be played back at more than one selected times, each of which may be transmitted to the hearing instrument together with the message in question for storage in the hearing instrument.

Preferably, the corresponding speech message is digitized in the device into digital audio samples that is transmitted to the hearing instrument and stored in an audio file in the memory of the hearing instrument, whereby the corresponding speech message is stored in the hearing instrument in the form of an audio file. At play back, the digital audio samples of the audio file is converted to an analogue audio signal in a digital-to-analogue converter of the hearing instrument and the analogue audio signal is input to an output transducer, such as a loudspeaker (termed a receiver in a hearing aid), for conversion into a corresponding acoustic speech message that is transmitted towards the eardrum of the user.

In this way, the user is relieved from the task of consulting other equipment to check on reminders and updates; rather, the user need not change anything or take any particular actions in order to be able to receive corresponding speech messages.

The transmission of messages from the device to the hearing instrument need not take place at the time at which the hearing instrument plays the corresponding speech message back. Rather, the transmission may occur anytime before the time of play back, e.g. a reminder may be transmitted to the hearing instrument together with the selected time for play back of the reminder, upon recording or editing of the reminder; whenever the hearing instrument is within receiving range of the transmitter of the device and a communication link between the device and the hearing instrument has been performed.

The data rate of the transmission may be slow, since the message is not streamed; rather, the data is stored in a memory in the hearing instrument for later play back. Thus, data transmission may be performed whenever data transmission resources are available. Thus, there is no need for the device to be in contact with the hearing instrument at the precise time of play back of the corresponding speech message, e.g. reminding the user of something.

In this way, the communication link, e.g. the wireless communication link, between the device and the hearing instrument need not be particularly fast or particularly reliable. For example, the link data rate need not be fast enough to transmit audio in real-time. Still, the corresponding speech messages may be played back to the user as high quality audio, since the corresponding speech messages may be transmitted to the user at a data rate much higher than the data rate of the communication link.

Thus, data transmission between the device and the hearing instrument may be performed slowly, whenever the communication link is available, and the data transmission is robust to possible communication drop outs, e.g. due to noise.

Since the data rate is not critical, and since data transmission may be interrupted and resumed without interfering with the desired timing of corresponding speech message play back to the user, the transmission from the device to the hearing instrument may be performed in the background without interfering with the other desired functions of the hearing instrument.

Processing, including signal processing, message processing, and corresponding speech message processing, in the new hearing instrument may be performed by dedicated hardware or may be performed in a signal processor, or performed in a combination of dedicated hardware and one or more signal processors.

As used herein, the terms "processor", "central processor", "message processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "central processor", "message processor", "signal processor", "controller", "system", etc., designate both an application running on a processor and a hardware processor. One or more "processors", "central processors", "message processors", "signal processors", "controllers", "systems" and the like, or any combination hereof, may reside within a process and/or thread of execution, and one or more "processors", "central processors", "message processors", "signal processors", "controllers", "systems", etc., or any combination hereof, may be localized in one hardware processor, possibly in combination with other hardware circuitry, and/or distributed between two or more hardware processors, possibly in combination with other hardware circuitry.

A hearing instrument configured for use with a device, the hearing instrument includes: an interface for reception of a message and/or a speech message from the device, wherein the speech message is a converted form of the message and is generated using a text-to-speech processor; a memory for storage of the message and/or the speech message, and a message processor configured for, at a selected time, outputting audio samples of the speech message for transmission to a user of the hearing instrument.

Optionally, the hearing instrument further includes the text-to-speech processor; wherein the interface is configured for reception of the message, not the speech message; and wherein the text-to-speech processor of the hearing instrument is configured to convert the message to the speech message.

Optionally, the hearing instrument comprises a hearing aid.

Optionally, the hearing instrument comprises a timer that is synchronized with a timer of the device, and wherein the message processor is configured for automatically outputting the audio samples at the selected time as determined with the timer.

Optionally, the interface is also for reception of information regarding the selected time from the device.

Optionally, the hearing instrument is a part of a hearing instrument system that includes the device.

Optionally, the text-to-speech processor is a part of the device, and wherein the interface of the hearing instrument is configured for reception of the speech message, not the message, from the device after the text-to-speech processor of the device has converted the message to the speech message.

Optionally, the device is configured to transmit the message and/or the speech message to the hearing instrument upon detection of a connection with the hearing instrument.

Optionally, the device comprises: a first interface that is configured for connection with a Wide-Area-Network, a second interface configured for connection with the hearing instrument, and a central processor configured for controlling reception of information relating to the user through the Wide-Area-Network, and transmission of the message and/or the speech message to the hearing instrument based on the information.

Optionally, the selected time is included in the information.

Optionally, a duration of the transmission of the message to the hearing instrument is longer than a duration of the transmission of the audio samples of the speech message to the user.

Optionally, the hearing instrument system further includes a user interface configured to receive a user command to sequentially output two or more messages stored in the memory of the hearing instrument for transmission to a user of the hearing instrument system.

Optionally, the hearing instrument system further includes a user interface configured to receive a user command to delete a selected message in the memory of the hearing instrument.

Optionally, the hearing instrument system further includes a user interface configured to receive a user command to repeat transmission of a selected message.

Optionally, the hearing instrument system further includes a user interface configured to receive a user command to mute a selected message.

A device for use with a hearing instrument includes: a first interface that is configured for reception of information relating to a user through a Wide-Area-Network, the information comprising timing information; a second interface configured for connection with the hearing instrument; and a processor configured to control the second interface to output a message and/or a speech message to the hearing instrument based on the timing information, wherein the speech message is a converted form of the message and is generated using a text-to-speech processor.

A method of communicating a message includes: retrieving the message from a device with access to a Wide-Area-Network; converting the message into a corresponding speech message; storing the message and/or the corresponding speech message in a memory of a hearing instrument together with timing information, and outputting the corresponding speech message for a human at a date and time as defined by the timing information.

Optionally, the hearing instrument system further includes the speech message, not the message, is stored in the memory of the hearing instrument.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DETAILED DESCRIPTION

Figure 1:
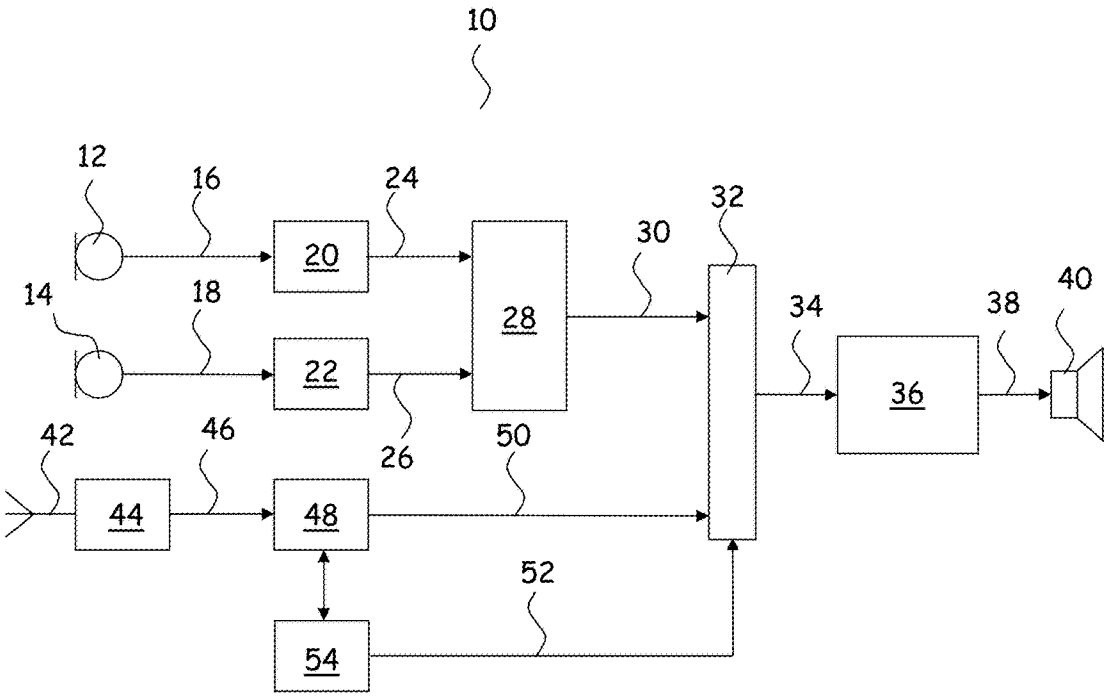
FIG. 1 schematically illustrates electronic circuitry of the new hearing instrument, FIG. 2 schematically illustrates another electronic circuitry of the new hearing instrument, and FIG. 3 schematically illustrates the new hearing instrument system.

Various exemplary embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or not so explicitly described.

The new method, hearing instrument, and hearing instrument system will now be described more fully hereinafter with reference to the accompanying drawings, in which various examples of the new method, hearing instrument, and hearing instrument system are illustrated. The new method, hearing instrument, and hearing instrument system according to the appended claims may, however, be embodied in different forms and should not be construed as limited to the examples set forth herein.

FIG. 1 schematically illustrates exemplary hearing aid circuitry 10 of the new hearing instrument. The illustrated new hearing aid circuitry 10 may form part of any type of hearing aid of a suitable mechanical design, e.g. to be worn in the ear canal, or partly in the ear canal, behind the ear or in the concha, such as the well-known types: BTE, ITE, ITC, CIC, etc.

The illustrated hearing aid circuitry 10 comprises a front microphone 12 and a rear microphone 14 for conversion of an acoustic sound signal from the surroundings into corresponding microphone audio signals 16, 18 output by the microphones 14, 16. The microphone audio signals 16, 18 are digitized in respective ND converters 20, 22 for conversion of the respective microphone audio signals 16, 18 into respective digital microphone audio signals 24, 26 that are optionally pre-filtered (pre-filters not shown) and combined in signal combiner 28, for example for formation of a digital microphone audio signal 30 with directionality as is well-known in the art of hearing aids. The digital microphone audio signal 30 is input to the mixer 32 configured to output a weighted sum 34 of signals input to the mixer 32. The mixer output 34 is input to a hearing loss processor 36 configured to generate a hearing loss compensated output signal 38 based on the mixer output 34. The hearing loss compensated output signal 38 is input to a receiver 40 for conversion into acoustic sound for transmission towards an eardrum (not shown) of a user of the hearing aid.

The illustrated hearing aid circuitry 10 is further configured to receive audio signals from various devices capable of audio streaming, such as smart phones, mobile phones, radios, media players, companion microphones, broadcasting systems, such as in a public place, e.g. in a church, an auditorium, a theatre, a cinema, etc., public address systems, such as in a railway station, an airport, a shopping mall, etc., etc.

In the illustrated example, digital audio, including audio samples of speech messages, are transmitted wirelessly to the hearing aid, e.g. from a smart phone, and received by the hearing aid antenna 42 connected to a radio receiver 44. The radio receiver 44 retrieves the audio samples 46 from the received radio signal, and the time and date at which the audio samples of the speech message is to be played back to the user, possible transmitter identifiers, and possible network control signals, etc. The audio samples of the speech message are stored in an audio file in the memory 48 together with the time and date, at which the audio file, i.e. the speech message, has to be played back to the user.

At the time and date at which the corresponding speech message is to be played back to the user, the message processor 54 controls retrieval of the audio samples from the memory 48 and forwarding of the audio samples 50 to the mixer 32. The message processor 54 also sets the weights 52 with which the digital microphone audio signal 30 and the audio samples 50 are added together in the mixer 32 to form the weighted output sum 34.

The weights may be set so that the audio file is played back to the user while other signals input to the mixer are attenuated during play back of the audio file. Alternatively, all or some of the other signals may be muted during play back of the audio file. The user may enter a command through a user interface of the hearing aid of a type well-known in the art, controlling whether the other signals are muted or attenuated.

The hearing aid may store more than one speech message with identical or similar time and dates to be played back; i.e. one or more speech messages may be going to be played back during ongoing play back of another speech message, whereby play back of more than one speech message may overlap fully or partly in time.

Such a situation may be handled in various ways. For example, the hearing aid may simultaneously play back more than one speech message; i.e. one or more messages may be played back during ongoing play back of another speech message, whereby more than one speech message may be played back simultaneously or partly simultaneously. In the mixer 32, each speech message is treated as a separate input to the mixer 32 added to the output of the mixer with its own weights, whereby the speech messages are transmitted to the user with substantially unchanged respective times for play back.

Alternatively, the speech messages may have assigned priorities and may be transmitted to the hearing aid together with information on the priority, e.g. an integer, e.g. larger than or equal to 1, e.g. the lower the integer, the higher the priority. Alarm messages may for example have the highest priority, while traffic announcements may have the second highest priority, and possible other communications may have the lowest priority. Such messages may then be played back sequentially in the order of priority one at the time without overlaps.

The hearing aid may be configured to always mute one or more other signals received by the hearing aid during transmission of a speech message of highest priority towards the eardrum of the user of the hearing aid.

Figure 2:
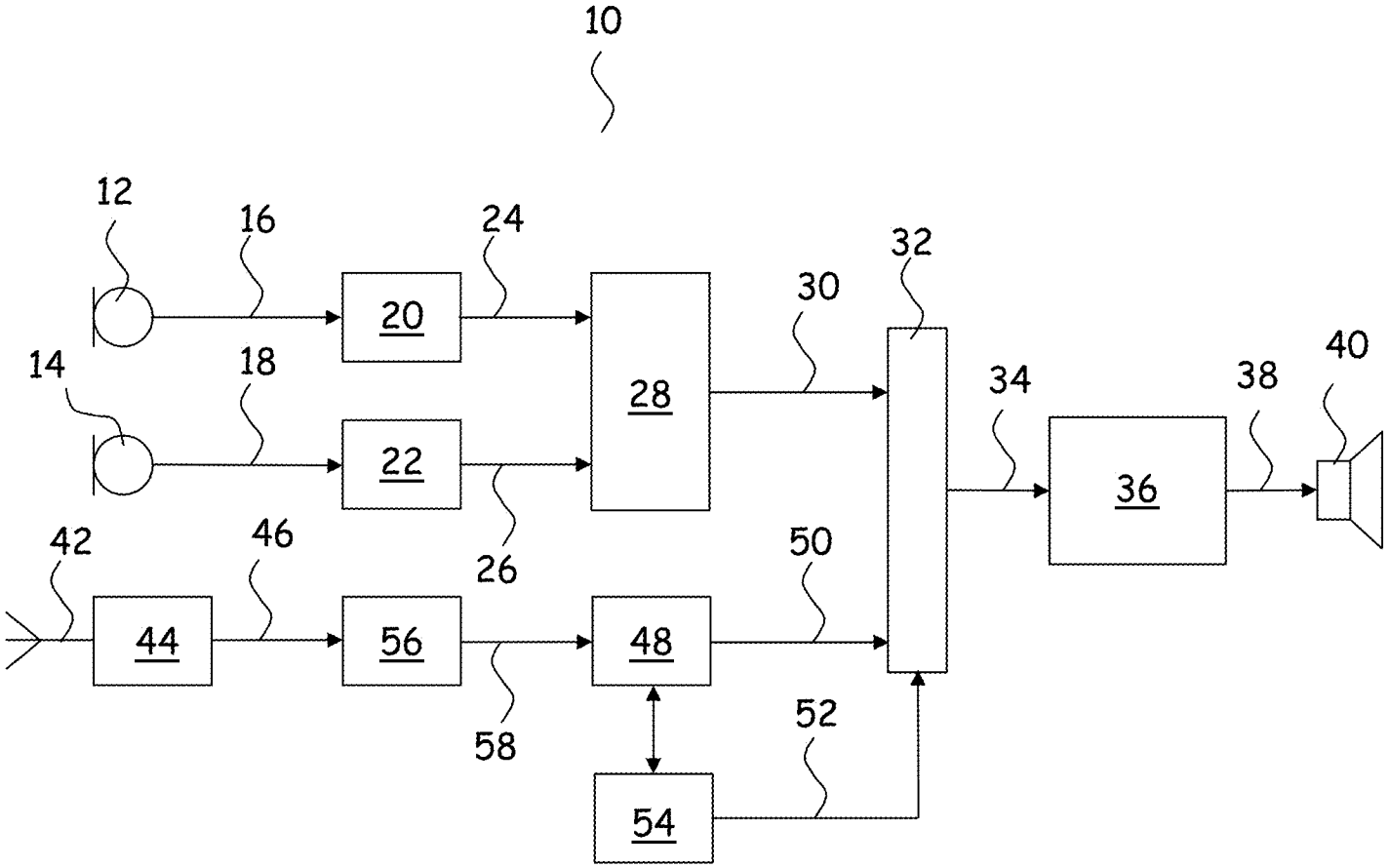

FIG. 2 schematically illustrates another exemplary hearing aid circuitry 10 of the new hearing instrument system that is identical to the hearing aid circuitry 10 of FIG. 1 and operates in a similar way except for the fact that the hearing aid circuitry 10 includes the text-to-speech processor 56 that is configured to convert messages received from the device into the speech messages that is played back to the user at the selected time previously specified during recording or editing of the information on which the message is based. In the illustrated circuitry 10 of the hearing aid, the message is converted into a speech message at receipt of the message, and the speech message is stored in an audio file in the memory 48. In another circuitry (not shown), the message is converted into a corresponding speech message at the selected time, i.e. at the time for play back to the user. Thus, the message is stored in the memory 48 and converted into a corresponding speech message immediately upon retrieval of the message.

In the illustrated circuitry 10, the text-to-speech processor 56 is configured to generate a speech message, such as a spoken reminder, from the text message received from the device, and the generated digital audio samples 58 are stored in an audio file in the memory 48 in the hearing aid for subsequent transmission to the mixer 32 at the selected time also received from the device and stored in the memory 48.

Figure 3:
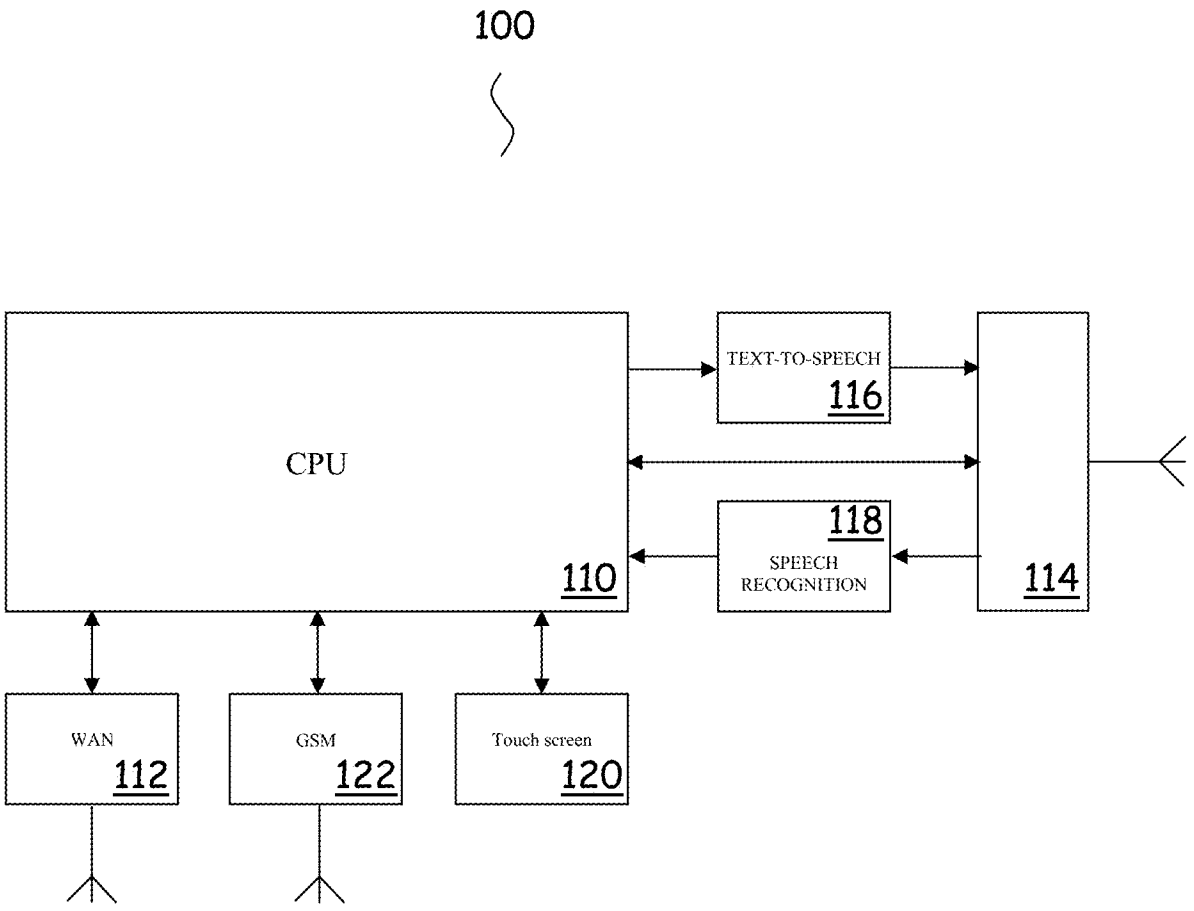

FIG. 3 schematically illustrates electronic circuitry 100 of the device of the hearing aid system, which is a smart phone.

The device has a user interface 120, namely a touch screen 120 as is well-known from conventional smart phones, for user control and adjustment of the device and possibly the hearing aid (not shown) interconnected with the device.

The user may use the user interface 120 of the smart phone 100 to input information to the tools (not shown) in a way well-known in the art.

The smart phone 100 may further transmit speech messages output by the text-to-speech processor 116 to the hearing aid through the audio interface 114.

In addition, the microphone of the hearing aid may be used for reception of spoken user commands that are transmitted to the device for reception at the interface 114 and input to the unit 118 for speech recognition and decoding of the spoken commands and outputting the decoded spoken commands as control inputs to a central processor 110. The central processor 110 controls the hearing aid system to perform actions in accordance with the received spoken commands.

The central processor 110 also controls an Internet interface 112 configured for connection with the Internet, e.g. a Wireless Local Area Network interface, a GSM interface 122, etc, and a wired audio and data interface 114, preferably a low power wireless interface, such as the Bluetooth Low Energy wireless interface, configured for connection with the hearing aid for transmission and reception of audio samples and other data to and from the hearing aid.

Through the Internet, the device has access to electronic time management and communication tools used by the user for communication and for storage of time management and communication information relating to the user.

The tools may include electronic calendar system(s), email system(s), such as Microsoft Outlook Express, Lotus notes, Windows Mail, Mozilla Thunderbird, Postbox, Apple Mail, Opera Mail, KMail, Hotmail, Yahoo, Gmail, AOL, etc, social network(s), professional network(s), such as Facebook®, LinkedIn®, Google+, tumblr, Twitter, MySpace, etc, RSS/Atom feeder(s), such as Bloglines, Feedly, Google Reader, My Yahoo!, NewsBlur, Netvibes, etc, news feeder(s), etc, well-known for management of daily activities and communications.

Reminders, notifications, and received communication may include tasks to be performed, reminders of calendar dates, such as birthdays, anniversaries, appointments, meetings, etc, notifications on receipt of new SMS or new email, new Facebook update, new tweet, new RSS feed, new traffic announcement, etc, and/or the actual item notified, e.g. the SMS itself.

The central processor 110 is configured to access the tools for electronic time management and communication facilitating use of the hearing instrument system to manage daily activities and communication through the Wide-Area-Network. A hearing aid app (not shown) executed by the central processor 110 instructs the smart phone to forward reminders and updates and received communication from the tools to the hearing aid as speech messages in accordance with settings previously made by the user and recorded with the tools.

The device comprises the text-to-speech processor 116 configured for conversion of messages, such as reminders or notifications or received communication etc, into speech messages for transmission to the hearing aid.

The user may have a plurality of devices with internet interfaces providing access to the tools and information relating to the user, and some or all of such devices may have the text-to-speech processor 116 and the interface 114 to the hearing aid and may constitute the device disclosed above.

The speech message is transmitted to the hearing aid together with timing information on the date and time of day of play back of the speech message. Speech messages that are desired to play back without delay after receipt by the hearing aid may have zeroes in the transmitted date field.

Typically, when the user accesses the tools in order to record or edit an event that requires attention or a task to be performed, the user has the option of specifying a message, namely a reminder, to be sent to the user in advance. Typically, the user may select that the reminder is forwarded as an SMS and/or an email and/or displayed in a pop-up window on a computer and/or is forwarded to the hearing aid as a speech message.

Further, the user may select the time of presentation of the reminder to the user in several ways. For example, the user may specify the date and time of day for presentation of the reminder to the user, or the user may specify the number of seconds, minutes, hours and/or days in advance of term expiry of the recorded event or task, the reminder should be presented to the user, e.g. 3 days before a recorded birthday, or the user may specify the number of seconds, minutes, hours and/or days to elapse from data entry until presentation of the reminder to the user, etc.

Typically, the user also receives messages in the form of notifications on incoming communication, such as receipt of a new email, SMS, instant message, etc, or receipt of updates in social or professional networks, such as Facebook, Twitter, LinkedIn, etc, RSS/Atom feeds The message may also include received information, e.g. an email, an SMS, a post in social or professional network, a blog post, an RSS/Atom feed, a news feed, an instant message, etc.

Thus, examples of speech messages include reminders on, e.g. meetings, birthdays, social gatherings, journeys, to-do items, etc, and notifications on, e.g., tweets, emails, news, traffic updates, social network updates, web page updates, etc, and communication, e.g. an email, an SMS, a post in social or professional network, a blog post, an RSS/Atom feed, a news feed, an instant message, etc.

The speech message may be accompanied by a distinct sound, such as short single note tone, or a distinct sequence of notes, such as a notification jingle, such as a personalized notification jingle.

Figure 4:
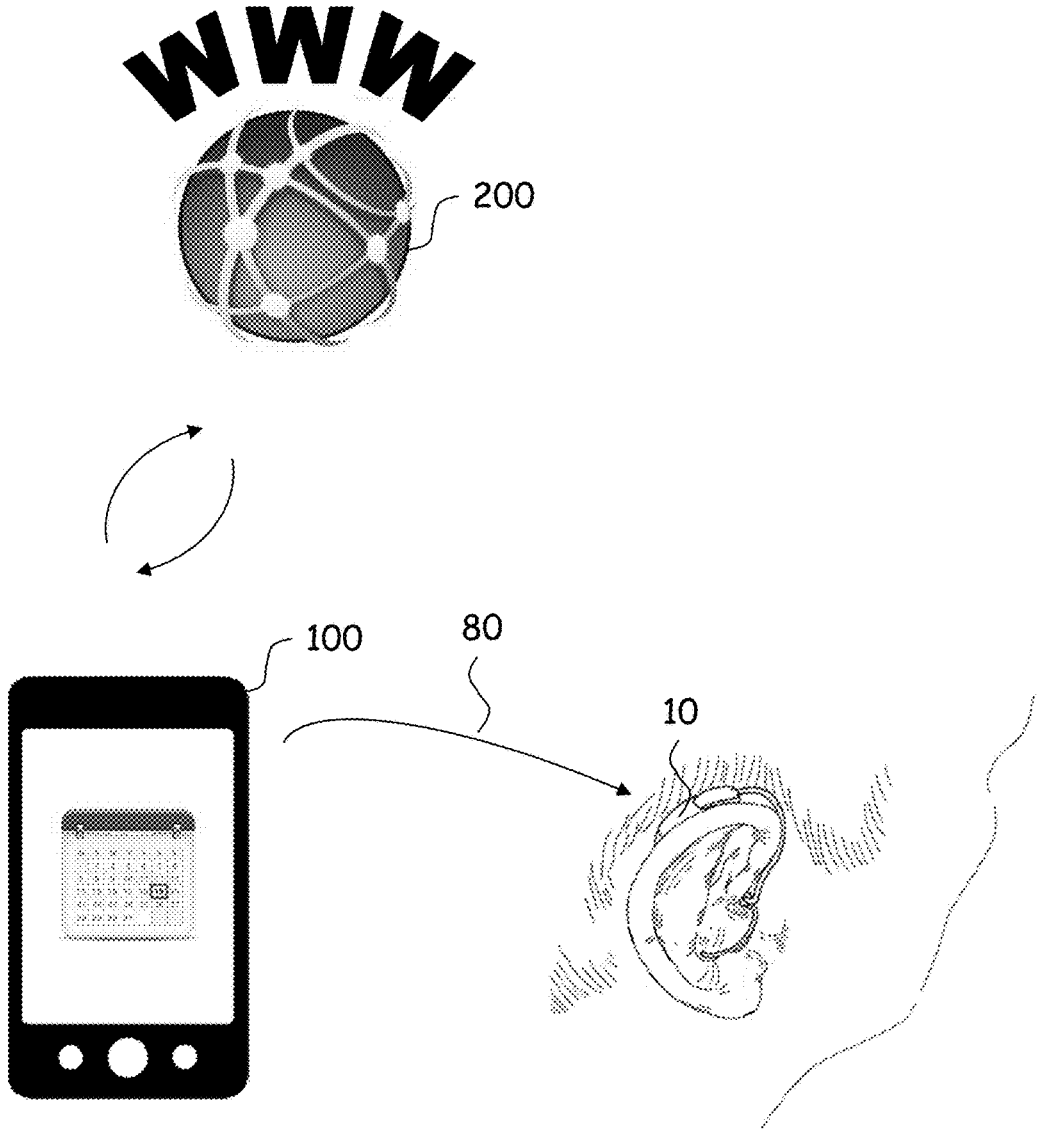
FIG. 4 schematically illustrates a new hearing aid system and its operation

FIG. 4 schematically illustrates a new hearing aid system and its operation. In the illustrated example, the Wide-Area-Network is the Internet 200, and the hearing aid system comprises the device 100, namely a smart phone 100 operating as explained with reference to FIG. 3, and the hearing aid 10, namely a BTE hearing aid 10 operating as explained with reference to FIGS. 1 and 2.

The hearing aid 10 is configured for reception of a speech message 80 from the smart phone 100.

In one example, the speech message 80 is a reminder of a meeting taking place at the same day at 10 o'clock. The user recorded the meeting in his electronic calendar a week before, and the user also set a reminder to alert the user 15 minutes before start of the meeting, i.e. at 9.45 a.m. the same day. The user recorded the meeting with a computer at work without an interface to the hearing aid 10. However, the user has set the smart phone 100 to synchronize with the electronic calendar every half hour, whenever the smart phone is connected to the Internet through a WiFi network, and since the working place has a WiFi, the smart phone 100 was synchronized with the calendar server shortly after entry of the new meeting. The user has also set the smart phone 100 to send reminders to the hearing aid 100 within 24 hours of the time at which the reminders have to be played back by the hearing aid 10. The hearing aid 10 and the smart phone 100 establish a mutual communication link whenever they are within coverage of their radio transmitters. Since the user usually carries the smart phone 100 and the hearing aid 10 simultaneously, the communication link between them is usually in operation and thus, approximately at 10 am the day before the day of the meeting, the reminder is transferred as a speech message 80 to the hearing aid 10. The user set the reminder to be played back to the user 15 minutes before start of the meeting. Thus, at 9.45 am, the hearing aid 10 plays back the message "remember meeting with CEO in room 1A at 10 am" to the user. If the user presses a button (not visible) on the BTE housing within 15 seconds after termination of play back, the reminder is deleted from the memory of the hearing aid, and if not, the reminder is played back again 5 minutes before start of the meeting and subsequently deleted from the memory of the hearing aid.

The spoken reminder 80 is converted from a text reminder received by the smart phone 100 from the electronic calendar system through the Internet 200. The conversion to the spoken reminder takes place in a text-to-speech processor 116 in the smart phone 100. The text-to-speech processor 116 provides the spoken reminder as digital audio samples that is transmitted to the hearing aid 10 and stored in an audio file in the memory of the hearing aid. At play back, the digital audio samples of the audio file is converted to an analogue audio signal in a digital-to-analogue converter of the hearing aid and the analogue audio signal is input to a receiver of the hearing aid 10 that outputs the acoustic speech message to the user.

The user interface 120 of the smart phone 100 also constitutes a user interface of the time management and communication tools used by the user as is well-known in the art. The user interface 120 of the smart phone 100 also constitutes a user interface of the hearing aid as is well-known in the art.

In addition, the user interface 120 of the smart phone 100 is also used for user entry of conditions specifying when a speech message in the memory of the hearing aid is to be deleted, e.g. upon play back, upon second play back, upon receipt of a specific user entry, etc.

The user interface 120 of the smart phone 100 is also used to set volume levels of play back of the speech messages and the volume of reproduced sounds received by the microphone(s) of the hearing aid and possible other audio sources, such as media players, TV, radio, hearing loops, etc, of the hearing aid.

Other equipment than the smart phone 100 may also constitute the device. For example, the user may have a computer at home connected to the Internet with an interface to the hearing aid 10. Through the Internet, the home computer, like the smart phone, has access to the electronic time management and communication tools used by the user for communication and for storage of time management and communication information relating to the user, and like the smart phone 100, the computer regularly may regularly synchronize with the information handled by the tools as is well-known in the art. The tools may include electronic calendar system(s), email system(s), such as Microsoft Outlook Express, Lotus notes, Windows Mail, Mozilla Thunderbird, Postbox, Apple Mail, Opera Mail, KMail, Hotmail, Yahoo, Gmail, AOL, etc, social network(s), professional network(s), such as Facebook®, LinkedIn®, Google+, tumblr, Twitter, MySpace, etc, RSS/Atom feeder(s), such as Bloglines, Feedly, Google Reader, My Yahoo!, NewsBlur, Netvibes, etc, news feeder(s), etc, well-known for management of daily activities and communications.

The information may include tasks to be performed, calendar dates, such as birthdays, anniversaries, appointments, meetings, etc, contacts, websites of interest, etc.

Similar to the smart phone 100, the hearing aid 10 and the home computer establish a mutual communication link whenever they are within coverage of their respective radio transmitters, and whenever the communication link is established, the home computer transfers speech messages to the hearing aid 10.

Thus, the hearing aid 10 may receive speech messages from any device with which the communication link can be established.

The speech messages may also be notifications on incoming communication, such as receipt of a new email, SMS, instant message, traffic update, or updates in social or professional networks, such as Facebook, Twitter, LinkedIn, etc, RSS/Atom feeds The speech message may also include the received information, e.g. an email, an SMS, a post in social or professional network, a tweet, a blog post, an RSS/Atom feed, a news feed, an instant message, etc.

Thus, examples of speech messages include reminders on, e.g. meetings, birthdays, social gatherings, journeys, to-do items, etc, and notifications on, e.g., tweets, emails, news, social network updates, web page updates, etc, and communication, e.g. an email, an SMS, a post in social or professional network, a blog post, an RSS/Atom feed, a news feed, an instant message, etc.

Some speech messages may be played back immediately upon receipt by the hearing aid.

Speech messages to be played back immediately may be transmitted to the hearing aid together with a time and date to be played back equal to zero.

The speech message may be accompanied by a notification jingle, such as a personalized notification jingle.

The speech message, or the message, may be automatically removed from the memory of the hearing aid after play back in order to make the part of the memory occupied by the, possibly spoken, message available to a new, possibly spoken, message.

Typically, the user may access the tools and the stored information from any computer that is connected to the Wide-Area-Network by logging-in to a specific account, e.g. with a username and a password.

The user may authenticate other devices to access the tools and the stored information when logged-in to the account in question.

In order for the device to be authenticated and allowed access to the tools and the stored information and to receive information from the tools, the user may have to log onto the corresponding accounts from the device.

The hearing aid may have a timer providing information on date and time of day, and the message processor may be configured for transmitting the audio file at a selected date and time of day.

The timer may be synchronized with the device, e.g. whenever data is transmitted to the hearing aid.

The new hearing aid system takes advantage of the fact that a user of the hearing aid system, especially a hearing aid user, already wears the hearing aid and therefore, the user is able to listen to played back speech messages without having to perform additional tasks, such as mounting a headphone or headset on his or her head, bringing a telephone to the ear, looking at a screen and select information to be displayed and/or played back, looking at a dashboard of a car and select information to be displayed and/or played back, etc.

The hearing aid may have a wireless interface for reception of data transmitted from the device, including speech messages and possibly the selected time, i.e. timing information specifying when the hearing aid is controlled to play back the speech message.

The user may use a user interface of the hearing aid to command the hearing aid to sequentially play back the messages of the audio files currently stored in the memory of the hearing aid, e.g. in ascending or descending order of time of receipt, in ascending or descending order of time to be played back, etc, e.g. also specified by the user using the user interface.

The user may select a new time for the message to be played back using the user interface. For example, tapping a push button twice may cause the speech message to be played back again 5 minutes later.

Thus, the selected time may be a time for playing back the message as previously specified by the user during recording or editing of the event or task in question and transmitted to the hearing aid for storage together with the message in the hearing aid.

The speech message may be played back at more than one selected times, each of which may be transmitted to the hearing aid for storage with the message in question.

With the illustrated hearing aid system, the user is relieved from the task of consulting other equipment for updates on upcoming events and incoming communication; rather, the user need not change anything or take any particular actions in order to be able to receive speech messages.

The transmission of messages from the smart phone 100 to the hearing aid 10 need not take place at the time at which the hearing aid plays the speech message back. Rather, the transmission may occur anytime before the time of play back, e.g. a reminder may be transmitted to the hearing aid together with the time for play back of the reminder, upon recording or editing of the reminder; whenever the hearing aid is within receiving range of the transmitter of the device.

The data rate of the transmission may be slow, since the message samples is not used for streaming; rather, the data is stored in a memory in the hearing aid for later play back. Thus, data transmission may be performed whenever data transmission resources are available. Thus, there is no need for the device to be in contact with the hearing aid at the precise time of speech message play back, e.g. reminding the user of something.

In this way, the communication link, e.g. the wireless communication link, need not be particularly fast or particularly reliable. For example, the link data rate need not be fast enough to transmit audio in real-time. Still, the speech messages may be played back to the user as high quality audio, since the speech messages may be read out of the memory of the hearing aid at a data rate much higher than the data rate of the communication link.

Data transmission to the hearing aid may be performed, slowly, when the communication link is available, and the data transmission is robust to possible communication drop outs, e.g. due to noise.

Since the data rate is not critical, and since data transmission may be interrupted and resumed without interfering with the desired timing of speech message play back to the user, the synchronization may be performed in the background without interfering with the other desired functions of the hearing aid.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing instrument configured for use with a device, the hearing instrument comprising:

a microphone for generating a microphone output signal;

an interface for reception of a message and/or a speech message from the device, wherein the speech message is a converted form of the message and is generated using a text-to-speech conversion algorithm;

a memory for storage of the message and/or the speech message;

a message processor configured for outputting audio samples of the speech message; and a speaker configured to provide an audio signal for a user of the hearing instrument based on the microphone output signal and the audio samples of the speech message.

2. The hearing instrument according to claim 1, wherein the hearing instrument comprises a hearing aid.

3. The hearing instrument according to claim 1, wherein the hearing instrument comprises a timer that is synchronized with a timer of the device, and wherein the message processor is configured for automatically outputting the audio samples at a selected time as determined with the timer of the hearing instrument.

4. The hearing instrument according to claim 1, wherein the interface is also for reception of information regarding a selected time from the device.

5. A hearing instrument system comprising the hearing instrument of claim 1, and the device.

6. The hearing instrument system according to claim 5, wherein the device is configured to transmit the message to the hearing instrument upon detection of a connection with the hearing instrument.

7. The hearing instrument system according to claim 5, wherein the device comprises:

a first interface that is configured for connection with a Wide-Area-Network, a second interface configured for connection with the hearing instrument, and a central processor configured for controlling reception of information relating to the user through the Wide-Area-Network, and transmission of the message to the hearing instrument based on the information.

8. The hearing instrument system according to claim 7, wherein the time information indicating the selected time is included in the information.

9. The hearing instrument according to claim 1, wherein a duration of a transmission of the message to the hearing instrument is longer than a duration in which the audio samples of the speech message is outputted by the message processor.

10. The hearing instrument system according to claim 5, further comprising a user interface configured to receive a user command to sequentially output two or more messages stored in the memory of the hearing instrument for transmission to a user of the hearing instrument system.

11. The hearing instrument system according to claim 5, further comprising a user interface configured to receive a user command to delete a selected message in the memory of the hearing instrument.

12. The hearing instrument system according to claim 5, further comprising a user interface configured to receive a user command to repeat transmission of a selected message.

13. The hearing instrument system according to claim 5, further comprising a user interface configured to receive a user command to mute a selected message.

14. A communication method performed by a hearing instrument, comprising:

receiving a message or a speech message from a device, wherein the speech message is a converted form of the message and is generated using a text-to-speech conversion algorithm;

storing the message and/or the corresponding speech message in a memory of the hearing instrument, generating a microphone output signal by a microphone of the hearing instrument; and providing an audio signal by a speaker of the hearing instrument for a human based on the microphone output signal and audio samples of the speech message.

15. The method according to claim 14, wherein the speech message is stored in the memory of the hearing instrument.

16. The hearing instrument of claim 1, wherein the message comprises a device-generated notification.

17. The hearing instrument of claim 16, wherein the device-generated notification comprises a receipt of a new email, SMS, instant message, traffic announcement, or an update in a social or professional network.

18. The hearing instrument of claim 1, wherein the message comprises an email, a SMS, a post in a social or professional network, a blog post, a RSS/Atom feed, a news feed, or an instant message.

19. A hearing instrument configured for use with a device, the hearing instrument comprising:

a microphone for receiving sound and for generating a microphone output signal based on the received sound;

an interface for reception of a message and/or a speech message from the device, wherein the speech message is a converted form of the message and is generated using a text-to-speech conversion algorithm;

a memory for storage of the message and/or the speech message;

a processor configured to apply a first weight to the microphone output signal to obtain a weighted microphone output signal; and a speaker for providing an audio signal to a user of the hearing instrument, wherein the audio signal is based on the weighted microphone output signal and an audio sample of the speech message.

20. The hearing instrument of claim 19, wherein the processor is also configured to apply a second weight to the audio sample of the speech message to obtain a weighted audio sample, the first weight being different from the second weight.

21. The hearing instrument of claim 19, wherein the processor is configured to apply the first weight so that a volume associated with the microphone output signal will be reduced or muted while the audio sample of the speech message is being presented to the user as a part of the audio signal.

22. The hearing instrument of claim 20, further comprising a mixer for combining the weighted microphone output signal with the weighted audio sample.

23. The hearing instrument of claim 19, wherein the first weight is zero.

24. The hearing instrument of claim 19, wherein the processor is also configured to obtain the speech message from the memory and output the speech message at a predetermined future time.

25. The hearing instrument of claim 19, wherein the hearing instrument comprises a hearing aid configured to compensate for a hearing loss of the user.

26. The hearing instrument of claim 1, wherein the message processor is configured to output the audio samples of the speech message based on time information indicating a selected time.

27. The method of claim 14, wherein the message is transmitted from the device to the hearing instrument in a duration that is longer than a duration in which the audio signal based on the audio samples of the speech message is provided for the human.

28. The method of claim 14, further comprising storing time information in the memory of the hearing instrument.

29. The hearing instrument of claim 1, further comprising a mixer for combining the microphone output signal with the audio samples of the speech message.

30. The hearing instrument of claim 1, wherein the message processor is also configured to provide a first weight for the microphone output signal and a second weight for the audio samples.

31. The method of claim 14, further comprising combining the microphone output signal with the audio samples of the speech message.

32. The method of claim 14, further comprising applying a first weight for the microphone output signal and applying a second weight for the audio samples of the speech message.

33. The hearing instrument according to claim 26, wherein the time information comprises stored information.

34. The hearing instrument according to claim 26, wherein the time information indicates a predetermined future time.

35. The method according to claim 28, wherein the time information indicates a predetermined future time.

* * * * *